US006644732B1

(12) United States Patent
Lin

(10) Patent No.: US 6,644,732 B1
(45) Date of Patent: Nov. 11, 2003

(54) STRUCTURE OF A FOLDABLE CHAIR WITH A LOCKING MECHANISM

(75) Inventor: Steve Lin, Chiai (TW)

(73) Assignee: Compex International Co., Ltd., Chia I Hsien (TW)

( * ) Notice: Subject to any disclaimer, the term of this patent is extended or adjusted under 35 U.S.C. 154(b) by 0 days.

(21) Appl. No.: 10/377,609

(22) Filed: Mar. 4, 2003

(51) Int. Cl.[7] ..... A47C 4/00
(52) U.S. Cl. ..... 297/39
(58) Field of Search ..... 297/16.1, 35, 39

(56) References Cited

U.S. PATENT DOCUMENTS 5,054,848 A * 10/1991 Liu ..... 297/39
5,735,570 A * 4/1998 Tseng ..... 297/39
6,095,596 A * 8/2000 Chen ..... 297/39
6,206,462 B1 * 3/2001 Huang ..... 297/39
6,471,287 B1 * 10/2002 Liu ..... 297/32

* cited by examiner

*Primary Examiner*—Peter R. Brown
(74) *Attorney, Agent, or Firm*—Rosenberg, Klein & Lee

(57) ABSTRACT

A foldable chair is equipped with a locking mechanism for preventing it from accidentally folding in use, which includes two locking devices each consisting of a co-moving element, and an engaging element. Each of the co-moving elements is pivoted to a corresponding joint, at which the seat of the chair is pivoted to the back, at an upper end, and is pivoted to a corresponding rear support leg of the chair at a lower end so that it is in a substantially vertical position when the chair is moved to stretched position. The engaging elements are secured to corresponding rear support legs, and located at such position that the co-moving elements will engage them respectively when the chair is in the stretched position for use.

1 Claim, 4 Drawing Sheets

STRUCTURE OF A FOLDABLE CHAIR WITH A LOCKING MECHANISM

BACKGROUND OF THE INVENTION

1. Field of the Invention

The present invention relates to a foldable chair, more particularly one, which is equipped with a locking mechanism for preventing various parts thereof from being accidentally moved relative to each other when it is being used in a stretched position, thus making the chair stable and safe to use.

2. Brief Description of the Prior Art

Conventional foldable chairs are not equipped with locking mechanisms for locking the parts thereof in position when they are in the stretched position for use. Consequently, various parts of conventional foldable chairs are prone to be accidentally moved relative to each other when the chairs are being used. Therefore, the chairs tend to be shaky, and might even fold accidentally to cause injure to the sitters.

SUMMARY OF THE INVENTION

It is a main object of the present invention to provide a locking mechanism to a foldable chair so that various parts of the chair cannot be accidentally moved relative to each other when the chair is being used in the stretched position, and in turns, the chair is stable and safe to use.

The locking mechanism includes two locking devices each consisting of a co-moving element, and an engaging element. Each of the co-moving elements has a substantially inverted U shape, and is pivoted to a corresponding joint, at which the seat is pivoted to the back, at upper middle portion thereof, and is pivoted to a corresponding rear support leg of the chair at lower ends of the lateral portions; thus, the co-moving elements are in a substantially vertical position when the chair is moved to stretched position. The engaging elements are secured to the rear support legs, and located at such position that the upper middle portions of the inverted U shaped co-moving elements will engage both of them respectively when the chair is in the stretched position.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
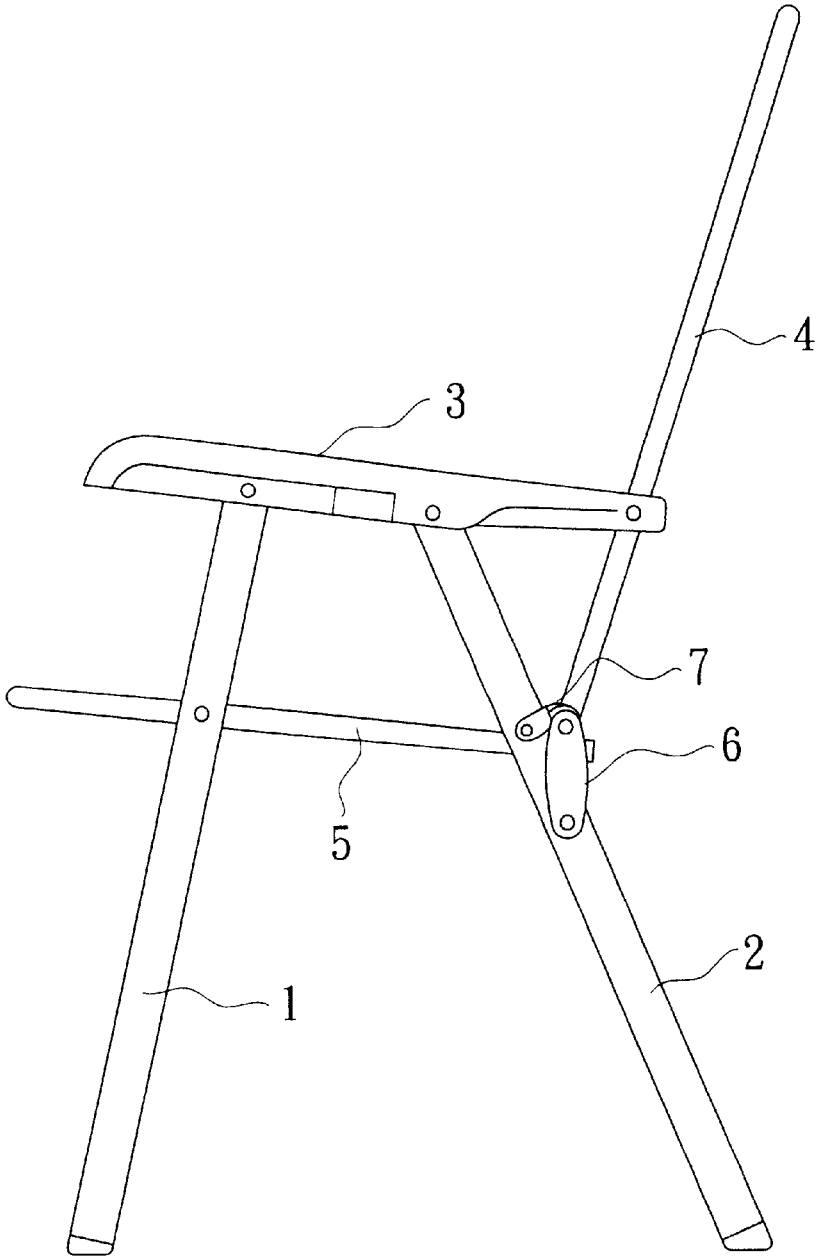
FIG. 1 a side view of the foldable chair according to the present invention, in the stretched in-use position.
Figure 2:
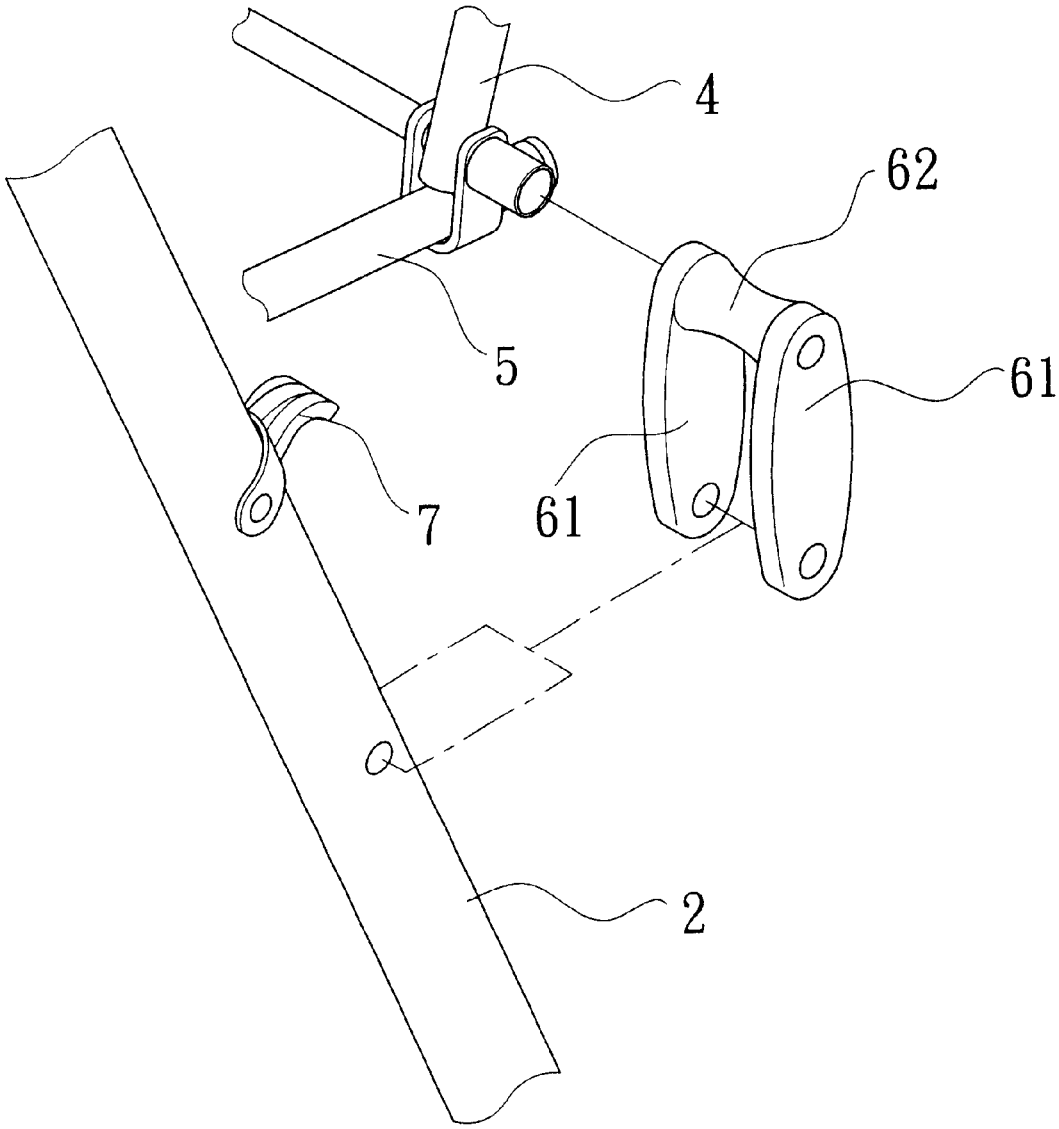
FIG. 2 is a partial exploded perspective view of the foldable chair according to the present invention.
Figure 4:
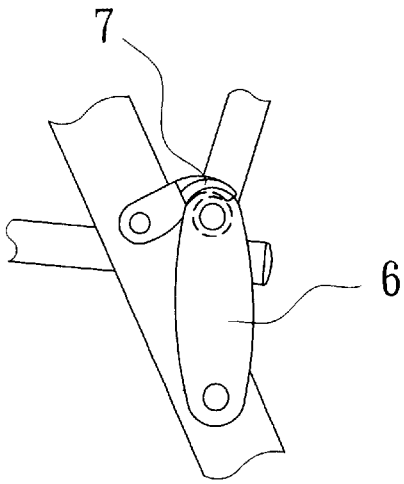
FIG. 4 is a partial side view of the foldable chair of the present invention in the stretched in-use position; and, FIG. 5 is a side view of the foldable chair according to the present invention, in the folded not-in-use position.
Figure 3:
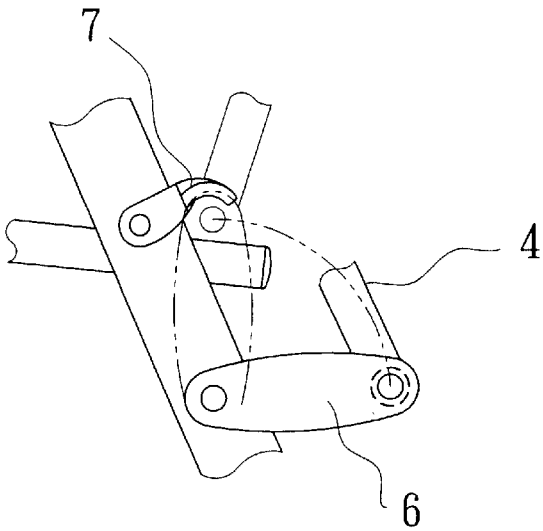
FIG. 3 is a partial side view of the foldable chair of the present invention, showing movement of the locking mechanism in stretching the chair.

Referring to FIGS. 1, and 2, a preferred embodiment of a foldable chair in the present invention includes a pair of front support legs 1, a pair of rear support legs 2, a pair of armrests 3, a back 4, a seat 5, and two locking devices, which each consists of a co-moving element 6, and an engaging element 7.

The front support legs 1 are pivoted to front portions of corresponding armrests 3 at upper ends thereof while the rear support legs 2 are pivoted to rear portions of corresponding armrests 3 at upper ends thereof. The armrests 3 are pivoted to corresponding lateral sides of the back 4 at rear ends thereof. Lower ends of the lateral sides of the back 4 are pivotally connected to corresponding ones of rear ends of two lateral sides of the seat 5. And, the seat 5 is pivotally connected to the front support legs 1 at the lateral sides thereof.

Each of the co-moving elements 6 is made to have two spaced out lateral portions 61, and a transverse rod 62 fixedly joined to upper ends of the lateral portions 61 to have an inverted U shape. The co-moving elements 6 are pivotally connected to respective ones of joints, at which the seat 5 is pivoted to the back 4, at the upper ends thereof, i.e. the transverse rods 62. In addition, the rear support legs 2 are passed between the lateral portions 61 of corresponding co-moving elements 6, and the co-moving elements 6 are pivotally connected to the rear support legs 2 at lower ends of the lateral portions 61 so that the co-moving elements 6 are in a substantially vertical position when the chair is moved to the stretched in-use position.

The engaging elements 7 each has a curved hook portion, and are fixedly secured to respective rear support legs 2. The curved hook portions of the engaging elements 7 face down and are located at such position that the upper transverse rods 62 of the co-moving elements 6 will engage both of them respectively when the present chair is moved to the stretched in-use position; thus, the co-moving elements 6 are secured in position, and in turns, the parts of the chair cannot be accidentally. moved relative to each other when the chair is being used in the stretched position.

Figure 5:
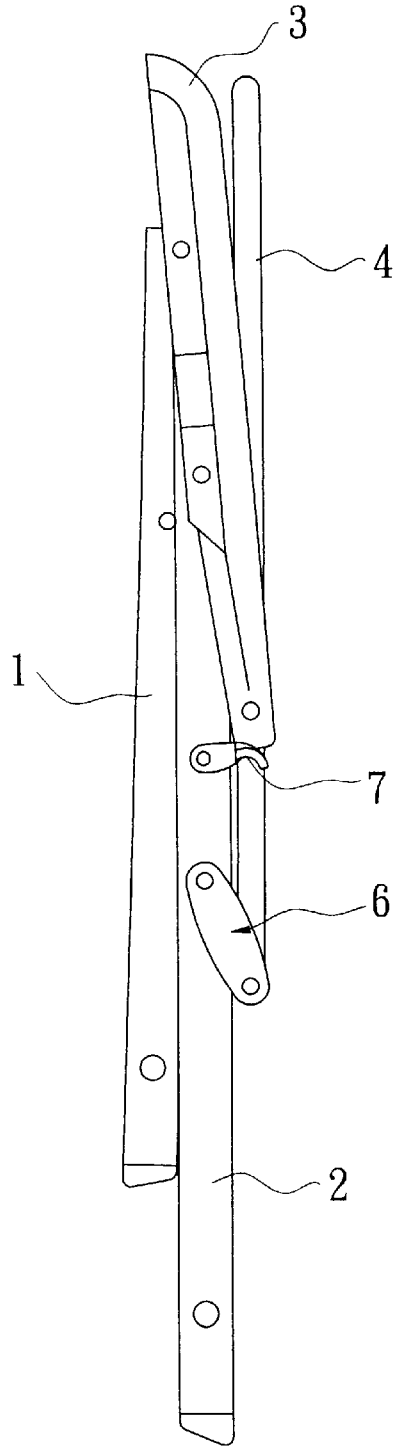

To fold the chair to a not-in-use position as shown in FIG. 5, the user has to first apply such a force on the chair that the co-moving elements 6 can be disengaged form the curved hook portions of the engaging elements 7.

From the above description, it can be easily understood that because the locking devices can prevent the parts of the present foldable chair from being accidentally moved relative to each other when the chair is being used, the foldable chair is relatively stable and safe to use.

What is claimed is:

1. A structure of a foldable chair with a locking mechanism, comprising a pair of armrests pivotally connected to upper ends of corresponding front support legs and upper ends of corresponding rear support legs;

a back pivotally connected to rear ends of the armrests at two lateral sides thereof;

a seat pivotally connected to the front support legs at front portions thereof, and pivotally connected to a lowermost part of the back at a rearmost part thereof; and two locking devices each consisting of a co-moving element, and an engaging element; each of the co-moving elements having two spaced out lateral portions, and a transverse rod fixedly joined to upper ends of the lateral portions; the co-moving elements being pivoted to respective ones of joints, at which the seat is pivoted to the back, at upper ends thereof; the rear support legs being passed between the lateral portions while the co-moving elements are pivoted to the rear support legs at lower ends of the lateral portions such that the co-moving elements are in a substantially vertical position when the chair is moved to a stretched position; the engaging elements each having a curved hook; the engaging elements being, secured to corresponding rear support legs with the curved hooks thereof facing down and being located at such position that the transverse rods will engage them respectively when the chair is in the stretched position.

* * * * *